US006507252B1

(12) United States Patent
Ho et al.

(10) Patent No.: US 6,507,252 B1
(45) Date of Patent: Jan. 14, 2003

(54) HIGH REJECTION EVANESCENT MIC MULTIPLEXERS FOR MULTIFUNCTIONAL SYSTEMS

(76) Inventors: Thinh Q. Ho, 1676 W. Sumac La., Anaheim, CA (US) 92802; Stephen M. Hart, P.O. Box 641032, San Jose, CA (US) 95164; Willard I. Henry, 1232 Green Bay St., San Diego, CA (US) 92154

( * ) Notice: Subject to any disclaimer, the term of this patent is extended or adjusted under 35 U.S.C. 154(b) by 0 days.

(21) Appl. No.: 09/886,501

(22) Filed: Jun. 21, 2001

(51) Int. Cl.[7] ..... H01P 1/213
(52) U.S. Cl. ..... 333/135; 333/202; 333/210
(58) Field of Search ..... 333/135, 202, 333/210, 219.1, 134, 136

(56) References Cited

U.S. PATENT DOCUMENTS

| | | | | |
|---|---|---|---|---|
| 3,603,899 A | | 9/1971 | Gyorgy | |
| 4,578,655 A | | 3/1986 | Etienne et al. | |
| 4,602,229 A | * | 7/1986 | Yester et al. | 333/208 |
| 4,626,809 A | * | 12/1986 | Mizumura et al. | 333/202 |
| 4,639,699 A | * | 1/1987 | Nishikawa et al. | 333/202 |
| 4,642,591 A | | 2/1987 | Kobayashi | |
| 5,786,739 A | | 7/1998 | Paul et al. | |
| 5,986,520 A | * | 11/1999 | Abeno et al. | 333/134 |
| 6,052,041 A | * | 4/2000 | Ishikawa et al. | 333/202 |
| 6,362,707 B1 | * | 3/2002 | Reinhardt | 333/219.1 |

* cited by examiner

*Primary Examiner*—Robert Pascal
*Assistant Examiner*—Dean Takaoka
(74) *Attorney, Agent, or Firm*—Celia C. Dunham; James A. Ward; Michael A. Kagan

(57) ABSTRACT

An integrated circuit multiplexer comprises a waveguide having an interior cavity, first RF input port, and a first and second output ports; a dielectric structure positioned in the cavity; an RF input feed attached to the dielectric structure that extends through the RF input port; a first RF output feed attached to the dielectric structure that extends through the first RF output port; a second RF output feed attached to the dielectric structure that extends through the second RF output port; a first resonator pair mounted to the dielectric structure between the RF input feed and the first RF output feed, and electrically connected to the waveguide; and a second resonator pair mounted to the dielectric structure between the RF input feed and the second RF output feed, and electrically connected to the waveguide so that the first and second resonator pairs are generally coplanar. The waveguide is shaped as a right rectangular prism having a rectangular cross-sectional area characterized by a width $L_1$ and a depth $L_2$, where $L_1<(0.5)\lambda$, $L_2<(0.25)\lambda$, and $\lambda$ represents the center wavelength of a radio frequency signal that is input into said waveguide so that the waveguide operates in an evanescent mode in response to receiving the radio frequency signal.

4 Claims, 2 Drawing Sheets

HIGH REJECTION EVANESCENT MIC MULTIPLEXERS FOR MULTIFUNCTIONAL SYSTEMS

BACKGROUND OF THE INVENTION

The present invention generally relates to microwave integrated circuits, and more particularly, to a microwave integrated circuit for multiplexing radio frequency input signals that operates in an evanescent mode.

The conventional approach for achieving signal addition or subtraction of radio frequency (RF) signals is through the use of microstrip line multiplexers. The drawbacks of technology are their large overall size and low rejection frequency response. Typical dimensions of the reactive elements of microstrip line multiplexers are on the order of $\lambda/4$, where $\lambda$ represents the wavelength of an RF signal of interest. Waveguide filters have been used at millimeter frequencies to provide sharp rejections, however, they are extremely large and heavy when they are used at low frequencies, i.e., less than 1 Ghz.

Multiband phased array systems may have hundreds to thousands of multiplexers in order to meet radiation and steering requirements. Integrated into each multiplexer are microwave integrated circuit (MIC) to process the signals for the phased array. Therefore, size and weight of the microwave integrated circuits are major factors of consideration in the design of phased array systems. Generally, multiplexers operate in the dominant mode so that the size of such devices depends on their frequency of operation.

Therefore, a need exists for a multiplexer that is small enough to be mounted on printed circuit boards, yet which still has the performance characteristics of larger waveguide multiplexers that operate in the dominant mode.

SUMMARY OF THE INVENTION

The present invention is an RF multiplexer than may be implemented using microwave integrated circuitry (MIC) technology to provide a multiplexer that operates with ultra-high Q evanescent mode in a metallized waveguide to perform RF signal distribution. Desired signals can operate at below the cut-off frequency of the dominant mode. Resonator elements may be fabricated using printed circuit fabrication techniques and embedded inside a low loss dielectrically loaded cavity that is coated with metallic materials. Respective inputs and outputs of the multiplexer in MIC format may be directly integrated with adjacent components on a printed circuit board. The invention enables high Q, small profile multiplexers to be effectively integrated with the active hardware of a communications system to provide low weight (LO) antenna systems. The invention also provides parallel signal multiplexing in a single housing and in real time. Additionally, the invention may be integrated on a single substrate with other communications components into a single, light weight structure.

An integrated circuit multiplexer embodying various features of the present invention comprises a waveguide having an interior cavity, first RF input port, and a first and second output ports; a dielectric structure positioned in the cavity; an RF input feed attached to the dielectric structure that extends through the RF input port; a first RF output feed attached to the dielectric structure that extends through the first RF output port; a second RF output feed attached to the dielectric structure that extends through the second RF output port; a first resonator pair mounted to the dielectric structure between the RF input feed and the first RF output feed, and electrically connected to the waveguide; and a second resonator pair mounted to the dielectric structure between the RF input feed and the second RF output feed, and electrically connected to the waveguide so that the first and second resonator pairs are generally coplanar. The waveguide is shaped as a right rectangular prism having a rectangular cross-sectional area characterized by a width $L_1$ and a depth $L_2$, where $L_1<(0.5)\lambda$, $L_2<(0.25)\lambda$, and $\lambda$ represents the center wavelength of a radio frequency signal that is input into said waveguide so that the waveguide operates in an evanescent mode in response to receiving the radio frequency signal.

These and other advantages of the invention will become more apparent upon review of the accompanying drawings and specification, including the claims.

BRIEF DESCRIPTION OF THE DRAWINGS

Throughout the several view, like elements are referenced using like references.

DESCRIPTION OF THE PREFERRED EMBODIMENT

Figure 1:
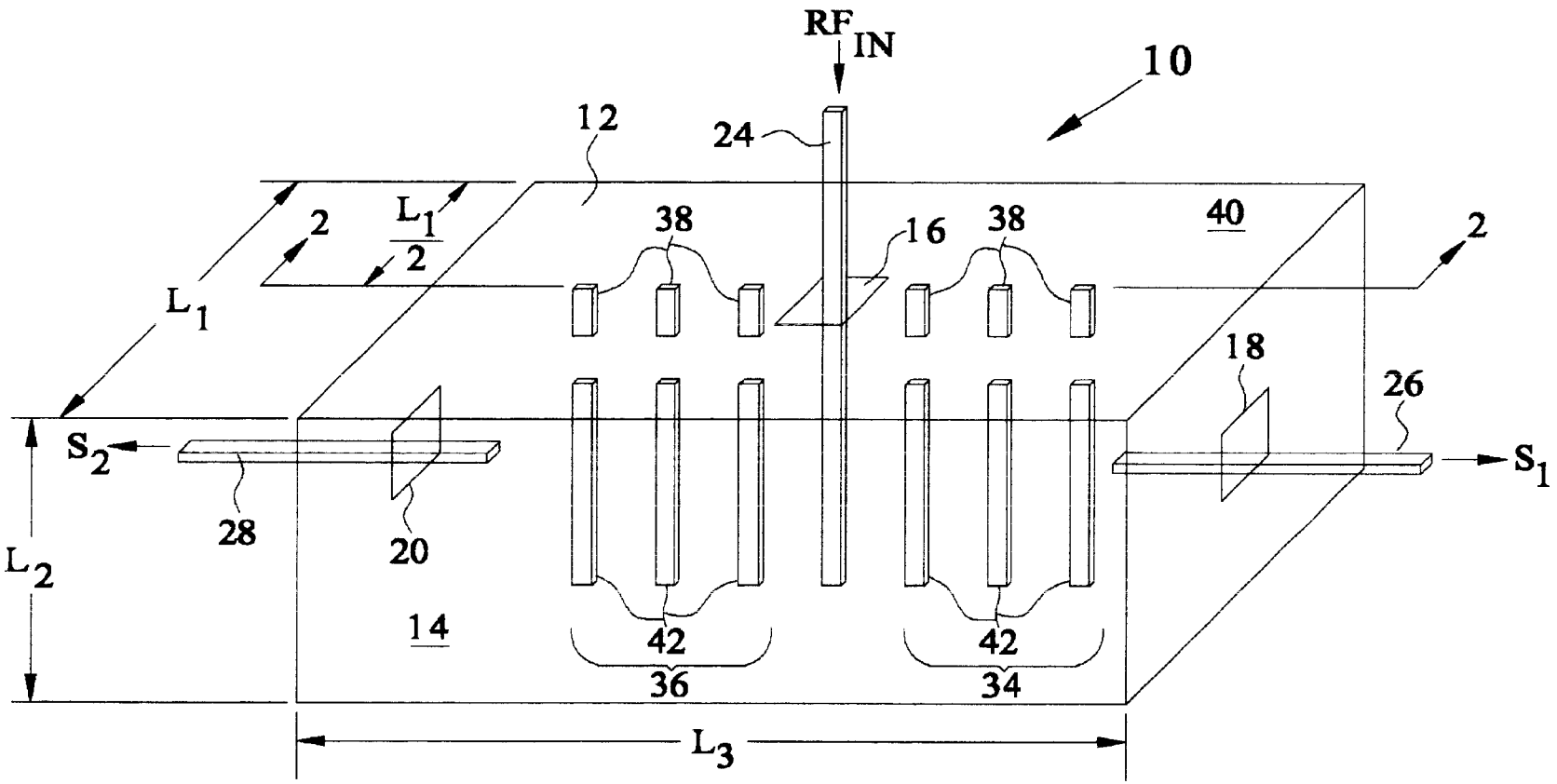
FIG. 1 is a phantom view of a microwave integrated circuit multiplexer that embodies various features of the present invention.

The present invention is directed to a microwave integrated circuit multiplexer system 10 that includes a metallic shell or waveguide 12 having an interior cavity 14, first RF input port 16 for receiving a radio frequency input signal $RF_{IN}$, a first RF output port 18, a second RF output port 20, and a dielectric structure 22 (shown in FIG. 2) positioned in the cavity 14 and having a generally planar surface 23. RF input port 16, RF output port 18, and RF output port 20 maybe apertures in waveguide 12. Waveguide 12 is generally shaped as a right rectangular prism having a width $L_1$. The material thickness of waveguide 12 is not critical, but in most applications is in the range of 50 to 100 mils. System 10 further includes an RF input feed 24 that extends through the RF input port 16 and is mounted to the planar surface 23, a first RF output feed 26 that is attached to the planar surface 23 and extends through the first RF output port 18, and a second RF output feed 28 that is attached to the planar surface 23 and extends through the second RF output port 20, a first resonator pair 34 mounted to said planar surface 23 between said RF input feed 24 and said first RF output port 18, and electrically connected to said waveguide 12, Each of RF input feed 24, RF output feed 26, and RF output feed 28 are electrically conductive and dielectrically isolated from waveguide 12. Feeds 24, 26, and 28 are manufactured of an electrically material such as metal strips or wire. Generally, waveguide 12 has a width $L_1$, where $L_1 \leqq (0.05)\lambda$ and $\lambda$ represents the center wavelength of $RF_{in}$, a depth $L_2$, where $L_2<0.25\ \lambda$, and a length $L_3$, where $L_3$ depends on the requirements of a particular application. Thus, it may be appreciated that waveguide 12 operates in an evanescent mode, where the frequency of $R_{IN}$ is less than the critical frequency $f_c$ of waveguide 12 would be if waveguide 12 were operating in the dominant mode, where $$f_c = \frac{c}{2L_1},$$

where c represents the speed of light in a vacuum. Another characteristic of system 10 is that a plane such as planar surface 23 is defined by coplanar resonator pairs 34 and 36, where such a plane is generally a perpendicular bisector of waveguide 12 at distance $L_1/2$ from side 46 of waveguide 12.

System 10 further includes one or more first resonator pairs 34 mounted to planar surface 23 between RF input feed 24 and RF output feed 26, and one or more second resonator pairs 36 that are mounted to planar surface 23 between RF input feed 24 and RF output feed 28. Each of resonator pairs 34 and 36 includes a first resonator element 38 that is direct current (DC) coupled to side 40 of waveguide 12, and second resonator elements 42 that are DC coupled to side 44 of waveguide 12, where side 44 serves as a ground plane. First resonator elements 38 are longitudinally aligned with and separated from second resonator elements 42 by a gap, $d_1$, where $d_1 \leqq (0.1)L_2$. The length $d_2$ represents the length of first resonator elements 38, where $d_2 \leqq (0.4)L_2$. The length $d_3$ represents the length of second resonator elements 42, where $d_3 = L_2 - (d_1 + d_2)$. The distance $d_4$ represents the distances between first resonator elements 38 and is much less than $\mu$. The width $d_5$ of each of first resonator elements 38, and second resonator elements 42 may be about 5–100 mil, and fabricated using standard printed circuit fabrication or photolithographic techniques. The distance $d_6$ represents the distance between the longitudinal center axis a—a of input feed 24 and the longitudinal center axis b—b of the nearest first resonator element 38 of resonator pairs 36. The distance $d_7$ represents the distance between the longitudinal center axis a—a of input feed 24 and the longitudinal center axis c—c of the nearest first resonator element 38 of resonator pairs 34. RF input feed 24 extends through input port 16 of waveguide 12, but does not have any DC contact with the waveguide 12. RF outputs 26 and 28 may be implemented as metal strips having a width of about $d_5$, or as wires that are bonded to the planar surface 23.

First resonator elements 38 and second resonator elements 42 may be flat metal strips made, for example, of copper, silver, aluminum or other electrically conductive materials having a thickness on the order of about 1 mil that are deposited or formed on planar surface 23 using standard integrated circuit fabrication techniques.

Figure 2:
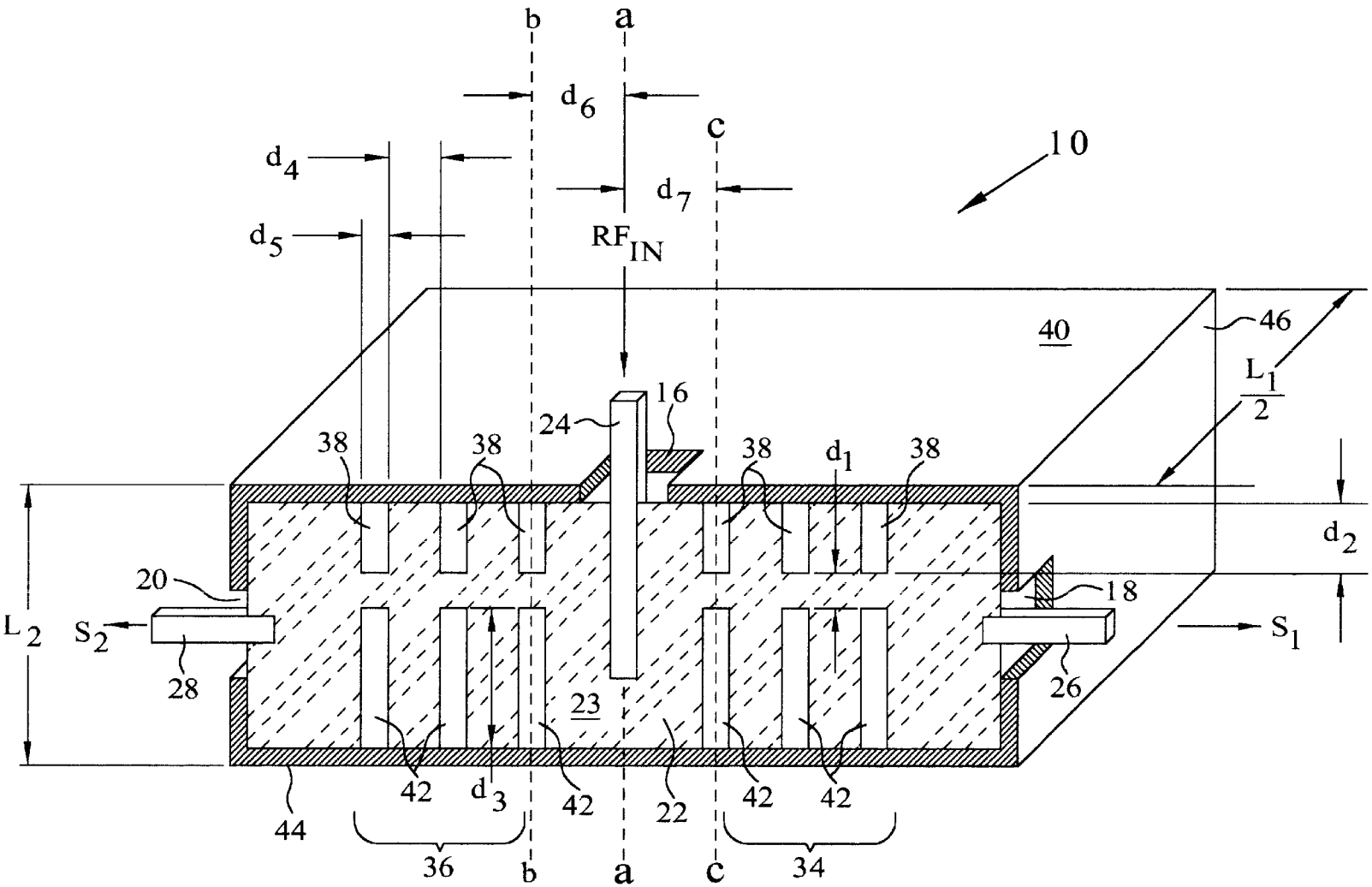
FIG. 2 is a cross-sectional view of the microwave integrated circuit of FIG. 1 taken along view 2—2.

Referring to FIG. 2, dielectric structure 22 may be made of foam, Bakelite, printed circuit board, or any other electrically insulating material that is capable of providing a substrate on which coplanar resonator pairs 34 and 36 may be supported, or positioned. Moreover, waveguide 12 may be formed by depositing a suitable patterned metal layer over dielectric structure 22.

In FIGS. 1 and 2, there are shown three resonator pairs 34 and 36 for purposes of illustration only. In general, the number of resonator pairs determines the frequency response roll-off characteristics of multiplexer 10. For example, increasing the number of resonator pairs results in multiplexer 10 having faster or steeper frequency response roll-off characteristics, whereas fewer number of resonator pairs results in multiplexer 10 having less steep, or slower frequency response roll-off characteristics. Therefore, it is to be understood that any number of resonator pairs 34 and 36 may be employed as necessary to suit the requirements of a particular application.

In the operation of multiplexer 10, signal $RF_{IN}$ is comprised of $S_1$ and $S_2$ RF components having wavelengths of $\lambda_1$ and $\lambda_2$, respectively, and is conducted into waveguide 12 via input feed 24. The distance $d_7$ is selected so that the $S_1$ component will be substantially conducted through waveguide 12 to output feed 26, but substantially not be conducted to output feed 28. The distance $d_6$ is selected so that the $S_2$ component will be substantially conducted through the waveguide 12 to output feed 28, but substantially not be conducted to output feed 28. The distances $d_6$ and $d_7$ may be determined numerically, analytically, experimentally, or through a combination of one or more of such techniques.

Obviously, many modifications and variations of the present invention are possible in light of the above teachings. It is therefore to be understood that within the scope of the appended claims, the invention may be practiced otherwise than as specifically described.

We claim:

1. An integrated circuit multiplexer comprising:

a waveguide having an interior cavity, first RF input port, and a first and second output ports;

wherein said waveguide defines a right rectangular prism which has a rectangular cross-sectional area having a width $L_1$ and a depth $L_2$, where $L_1 < (0.5)\lambda$, $L_2 < (0.25)\lambda$, and $\lambda$ represents the center wavelength of a radio frequency signal that is input into said waveguide;

a dielectric structure positioned in said cavity;

an RF input feed attached to said dielectric structure that extends through said RF input port;

a first RF output feed attached to said dielectric structure that extends through said first RF output port;

a second RF output feed attached to said dielectric surface that extends through said second RF output port;

a first resonator pair mounted to said dielectric structure between said RF input feed and said first RF output feed, and electrically connected to said waveguide; and a second resonator pair mounted to said dielectric structure between said RF input feed and said second RF output feed, and electrically connected to said waveguide such that said first and second resonator pairs are generally coplanar.

2. The integrated circuit multiplexer of claim 1 wherein said waveguide operates in an evanescent mode in response to receiving said radio frequency signal.

3. An integrated circuit multiplexer comprising:

a waveguide having an interior cavity, first RF input port, and a first and second output ports;

wherein said waveguide defines a right rectangular prism which has a rectangular cross-sectional area having a width $L_1$ and a depth $L_2$, where $L_1 < (0.5)\lambda$, $L_2 < (0.25)\lambda$, and $\lambda$ represents the center wavelength of a radio frequency signal that is input into said waveguide;

a dielectric structure positioned in said cavity;

an RF input feed attached to said dielectric structure that extends through said RF input port;

a first RF output feed attached to said dielectric structure that extends through said first RF output port;

a second RF output feed attached to said dielectric structure that extends through said second RF output port;

multiple first resonator pairs mounted to said dielectric structure between said RF input feed and said first RF output feed, and electrically connected to said waveguide; and multiple second resonator pairs mounted to said dielectric structure between said RF input feed and said second RF output feed, and electrically connected to said waveguide such that said first and second resonator pairs are generally coplanar.

4. The integrated circuit multiplexer of claim 3 wherein said waveguide operates in an evanescent mode in response to receiving said radio frequency signal.

* * * * *